US009278437B2

(12) United States Patent
Rakaczki et al.

(10) Patent No.: US 9,278,437 B2
(45) Date of Patent: Mar. 8, 2016

(54) HANDHELD POWER TOOL, IN PARTICULAR A POWER DRILL OR SCREWDRIVER

(75) Inventors: Janos Rakaczki, Miskolc (HU); Istvan Szell, Leifelden-Echterdingen (DE)

(73) Assignee: Robert Bosch GmbH, Stuttgart (DE)

( * ) Notice: Subject to any disclaimer, the term of this patent is extended or adjusted under 35 U.S.C. 154(b) by 615 days.

(21) Appl. No.: 13/532,760

(22) Filed: Jun. 25, 2012

(65) Prior Publication Data

US 2013/0161039 A1 Jun. 27, 2013

(30) Foreign Application Priority Data

Jun. 27, 2011 (DE) ..... 10 2011 078 082

(51) Int. Cl.
*B25F 5/00* (2006.01)
*B25B 21/00* (2006.01)
*B25F 5/02* (2006.01)

(52) U.S. Cl.
CPC . *B25B 21/00* (2013.01); *B25F 5/00* (2013.01); *B25F 5/02* (2013.01)

(58) Field of Classification Search
CPC ..... B25F 5/02; B25F 5/00; B25B 21/00
USPC ..... 173/15, 18, 170, 141, 217, 52, 4; 81/54, 81/57, 57.11, 57.14, 429
See application file for complete search history.

(56) References Cited

U.S. PATENT DOCUMENTS 3,773,117 A * 11/1973 Dussel ..... 173/4
4,162,639 A * 7/1979 Gill ..... 81/429
4,712,456 A * 12/1987 Yuan ..... 81/473
4,772,765 A * 9/1988 Markle et al. ..... 200/1 V
5,138,243 A * 8/1992 Kress et al. ..... 318/541
5,196,747 A 3/1993 Kress et al.
5,557,990 A 9/1996 Shin
5,973,275 A * 10/1999 Mozer et al. ..... 200/61.54
6,199,642 B1 * 3/2001 Becker et al. ..... 173/217
7,182,148 B1 * 2/2007 Szieff ..... 173/20
7,207,243 B1 * 4/2007 Lee ..... 81/58.3
7,878,090 B2 * 2/2011 Leupert ..... 81/57.11
8,286,723 B2 * 10/2012 Puzio et al. ..... 173/1
8,555,999 B2 * 10/2013 McRoberts et al. ..... 173/217
2006/0096770 A1 * 5/2006 Roberts ..... 173/217
2007/0050993 A1 * 3/2007 Phillips ..... 30/392
2007/0180956 A1 * 8/2007 Noguchi et al. ..... 81/54
2008/0264212 A1 10/2008 Leupert
2009/0031865 A1 * 2/2009 Alberti et al. ..... 81/57.11
2010/0044063 A1 * 2/2010 Chen ..... 173/93.5
2010/0288522 A1 * 11/2010 Sun et al. ..... 173/219
2012/0234139 A1 * 9/2012 Chen ..... 81/57.11
2013/0319185 A1 * 12/2013 Lai ..... 81/63.1
2014/0102742 A1 * 4/2014 Eshleman et al. ..... 173/183
2014/0166324 A1 * 6/2014 Puzio et al. ..... 173/20

FOREIGN PATENT DOCUMENTS

CN 85 1 08242 A 6/1986
CN 100491079 C 5/2009

* cited by examiner

*Primary Examiner* — Thanh Truong
*Assistant Examiner* — Dianne Mitchell
(74) *Attorney, Agent, or Firm* — Maginot, Moore & Beck LLP

(57) ABSTRACT

A handheld power tool has a tool holder for holding a tool, and a grip housing for holding and guiding the handheld power tool. A relative motion of the tool holder and the grip housing can be transmitted as a switching motion to a microswitch, which switches a drive unit on and off. The tool holder and the grip housing can be moved relative to one another in a direction of rotation, and the switching motion thus comprises a rotary motion of the grip housing.

12 Claims, 3 Drawing Sheets

HANDHELD POWER TOOL, IN PARTICULAR A POWER DRILL OR SCREWDRIVER

This application claims priority under 35 U.S.C. §119 to German patent application no. DE 10 2011 078 082.3, filed Jun. 27, 2011 in Germany, the disclosure of which is incorporated herein by reference in its entirety.

The disclosure relates to a handheld power tool, in particular to a power drill or screwdriver, e.g. a battery-operated drill or screwdriver.

BACKGROUND

U.S. Pat. No. 5,557,990 describes a battery-operated screwdriver having an electric drive motor, which drives a tool holder for holding a tool. The battery-operated screwdriver has a push-start mechanism for switching on the drive motor automatically as soon as the tool held in the tool holder is placed with pressure on the screw to be screwed in or unscrewed and the tool holder is moved axially backward into the housing. During this process, a radially projecting actuating element is moved axially by the tool holder and pressed against a microswitch, which switches the electric motor on and off.

The tool holder is urged into its initial position by the force of a spring element, with the result that the tool holder returns to its initial position as soon as the screwdriver is removed from the screw.

SUMMARY

It is the underlying object of the disclosure to provide a handheld power tool, such as a power drill or screwdriver, with a starting mechanism of structurally simple design which is intuitive to operate.

According to the disclosure, this object is achieved by the features set forth below. Expedient developments are also set forth below.

The handheld power tool, which is preferably a power drill or screwdriver, in particular a battery-operated screwdriver, has a tool holder for holding a tool, and a grip housing for holding and guiding the handheld power tool. A relative motion of the tool holder and the grip housing is possible and this can be transmitted as a switching motion to a microswitch, by means of which a drive unit can be switched on and off The drive unit is preferably an electric drive motor, which is accommodated in a housing of the handheld power tool. In the case of a battery-operated screwdriver, the electric drive motor is supplied with power by a battery, which is likewise accommodated in the housing of the handheld power tool. Generally, the housing furthermore also contains an electronic system for controlling the drive motor.

The relative motion of the tool holder and the grip housing comprises a relative rotary motion. The grip housing can be twisted relative to the tool holder or to a component connected to the tool holder about the longitudinal axis of the housing, which coincides, in particular, with the tool holder axis; this rotary motion is part of the switching motion for switching the microswitch on and off.

According to an expedient embodiment, the relative motion of the tool holder and the grip housing is made up of an axial component and of a component in a direction of rotation, in each case in relation to the longitudinal axis of the handheld power tool or tool holder axis, along which or about which the relative motion takes place. The switching motion for switching the drive unit on and off by means of the microswitch is thus also made up of the two component motions, namely the motion in an axial direction and the motion in a direction of rotation.

The combination of an axial and a rotary actuating motion allows the drive unit to be switched on in an intuitive manner since, after the tool held in the tool holder has been placed on the workpiece or screw to be worked upon, the grip housing is twisted relative to the tool holder in a direction of rotation by actuating the grip housing, and the axial spacing of the grip housing relative to the tool holder is shortened. By means of the rotation, the direction of rotation of the drive motor can be specified, while the axial motion switches the microswitch on and off. According to a preferred embodiment, the direction of rotation of the drive motor coincides with the direction of rotation of the grip housing, and therefore the rotary motion of the grip sleeve to the right or to the left also determines the direction of rotation of the drive motor in the corresponding direction.

When the electric drive motor is switched on, the two-part actuating motion is advantageously carried out in a predetermined order. First of all, the grip housing is twisted in order to specify the direction of rotation of the drive motor. However, the direction of rotation alone does not start the drive motor. The grip housing is then pushed forwards axially, thus shortening the axial spacing between the grip housing and the tool holder; the axial forward motion starts the drive motor in the desired direction of rotation by acting upon the microswitch. When switching off, the actuating motion of the grip housing takes place in a corresponding manner in the opposite direction.

In principle, a switching on motion in the reverse order is also possible, so that the grip housing is pushed forwards axially first and then moved in a direction of rotation. Moreover, superimposed axial and rotary actuating motions may also be considered.

This embodiment of the handheld power tool has the advantage that neither a sensor device for detecting the relative motion of the handle nor an ON/OFF switch on the housing of the handheld power tool is required to switch the drive motor on and off. Only the relative motion of the grip housing and the tool holder is responsible for switching the drive motor on and off and for specifying the direction of rotation of the drive motor.

In order to be able to produce both anticlockwise rotation and clockwise rotation of the tool holder through appropriate activation of the drive unit, it is expedient if, in relation to a neutral or initial position, the grip housing can be moved in opposite directions of rotation relative to the tool holder. The neutral position can be produced by means of a spring element, which urges the grip housing into the neutral position. In principle, an embodiment in which a spring element urging the grip housing in the direction of rotation is dispensed with, is also possible, ensuring that the grip housing remains in its twisted position even without intervention by the user.

It is advantageous if a spring element which urges the grip housing into the neutral or initial position in an axial direction is provided. The spring element counteracts the forward motion of the grip housing relative to the tool holder, with the result that the grip housing is moved back axially into its neutral or initial position by the force of the spring element as soon as the user is no longer applying any forward-acting force on the grip housing. During this axial return motion, the microswitch is switched off.

It is advantageous if the tool holder is held on an inner shell, which houses the drive unit and with respect to which the grip housing can perform the relative motion. The inner shell is at least partially surrounded by the grip housing.

According to another expedient embodiment, a latching element, which, in the driving position, is in engagement with a mating latching element, which is arranged on the tool holder or a component connected to the tool holder, is arranged on the grip housing. The latching element on the grip housing is designed as a pin on the inside of the grip housing, for example. The mating latching element on the tool holder or on the component connected thereto—generally the inner shell—is embodied in a corresponding manner as a groove, into which the pin can be engaged in the driving position. The latching engagement of the latching elements ensures that, in the driving position with the drive motor running, the grip housing is not inadvertently moved into a position in which the drive motor is unintentionally switched off or set to the opposite direction of running. The latching element and the mating latching element are accordingly embodied in such a way that inadvertent twisting of the grip housing and the tool holder relative to one another is prevented in the driving position. The groove on the component connected to the tool holder extends in an axial direction.

During a switch-on motion involving the twisting of the grip housing followed by an axial forward motion of the grip housing, the pin is, after the twisting motion, initially moved into the position in which axial entry of the pin into the groove is possible. With the axial forward motion that follows the twisting motion, the pin enters the groove, thus securing the relative twist of the grip housing and preventing the grip housing from accidentally leaving this rotational position.

The relative twist of the grip housing preferably ranges over a limited angular segment of, for example, plus/minus 10° in relation to the neutral or initial position.

BRIEF DESCRIPTION OF THE DRAWINGS

Further advantages and expedient embodiments can be found below, the description of the figures and the drawings, in which.

DETAILED DESCRIPTION

In the figures, identical components are provided with identical reference signs.

Figure 1:
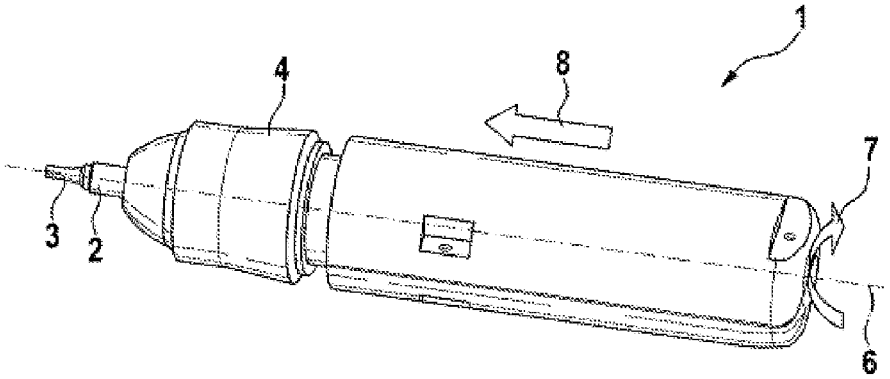
FIG. 1 shows a battery-operated screwdriver having a grip housing and a tool holder for holding a tool, wherein the tool holder is arranged on an inner shell, and the grip housing can perform an axial and rotary relative setting motion with respect to the inner shell.

As can be seen from the illustration in FIG. 1, the handheld power tool 1, which is embodied as a battery-operated screwdriver, has a tool holder 2 with a tool 3 held therein, e.g. a screwdriver bit, wherein the tool holder 2 is arranged securely on an inner shell 4, which houses the electric drive motor, the battery and the electronic system for activating the drive motor. The handheld power tool 1 furthermore has a grip housing 5, which at least partially surrounds the inner shell 4. Both the inner shell 4 and the grip housing 5 are embodied in two parts, comprising two half shells.

In relation to the longitudinal axis 6 of the handheld power tool 1, which coincides with the tool holder axis, the grip housing 5 can perform a relative rotary motion in direction of rotation 7 and a relative axial movement in axial direction 8 with respect to the inner shell 4, including the tool holder 2. The relative motion of the grip housing 5 with respect to the inner shell 4 can be used as a switching motion for actuating a microswitch, by means of which the electric drive motor can be switched on and off.

Figure 2:
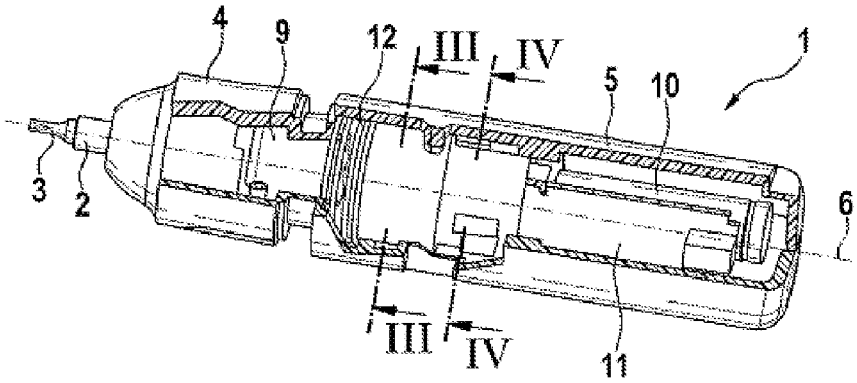
FIG. 2 shows a longitudinal section through the battery-operated screwdriver illustrated in the initial or neutral position of the grip housing.

As can be seen from the longitudinal section in FIG. 2, the cylindrical grip sleeve 5 partially surrounds the inner shell 4. The inner shell 4 houses the electric drive motor 9, which is supplied with power by a battery 10, the battery 10 and an electronic system 11 for activating the drive motor 9 being housed in the inner shell 4.

Mounted on the circumferential surface of the inner shell 4 is a spring element 12 in the form of a helical spring, which is held under preload between ribs on the circumferential surface of the inner shell 4. The spring element 12 urges the grip housing 5 into a neutral or initial position in an axial direction. If the grip housing 5 is moved axially towards the inner shell 4 or tool holder 2, as indicated in arrow direction 8 in FIG. 1, the grip housing 5 must be pushed forwards against the force of the spring element 12. If the user discontinues actuation of the grip housing, the grip housing 5 is pushed back axially into the neutral or initial position by the force of the spring element 12.

Figure 3:
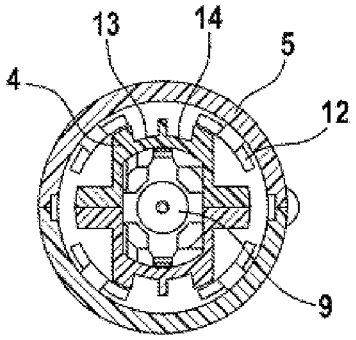
FIG. 3 shows a section transversely to the longitudinal axis along line of section III-III in FIG. 2.
Figure 6:
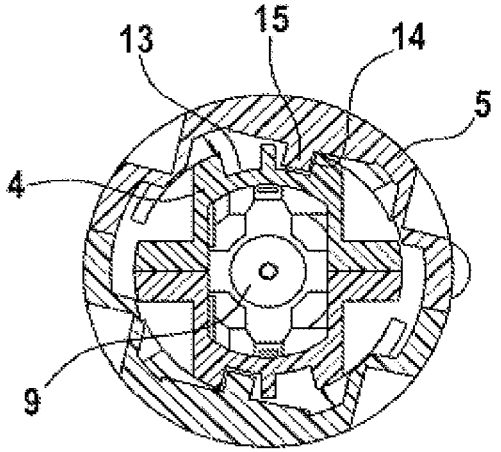
FIG. 6 shows a section transversely to the longitudinal axis along line of section VI-VI in FIG. 5.

As can be seen from the sectional representation in FIG. 3, two grooves 13 and 14 extending in an axial longitudinal direction are introduced into the circumferential surface of the inner shell 4. The grooves 13, 14 are situated in a section of the inner shell which is overlapped by the grip housing 5. The grooves 13 and 14 represent mating latching elements, which interact in the driving position with a latching pin 15 (FIG. 6), which is arranged on the inside of the grip housing 5 and extends radially inwards. The engagement of the latching pin 15 in the grooves 13 and 14 takes place in the driving position and secures the grip housing 5 against an unintentional rotary motion.

Figure 4:
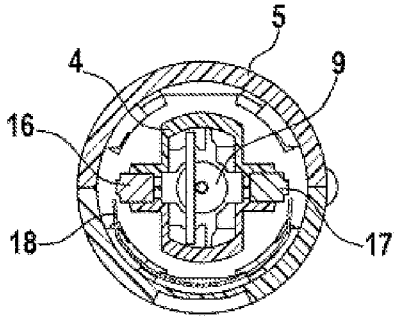
FIG. 4 shows a section transversely to the longitudinal axis along line of section IV-IV in FIG. 2.
Figure 5:
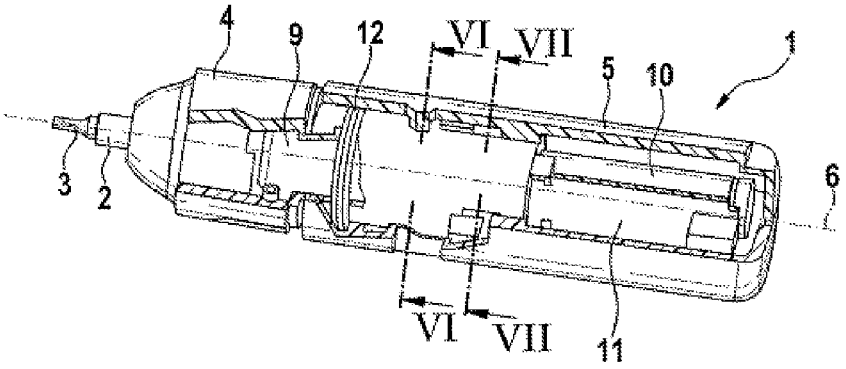
FIG. 5 shows a sectional representation, corresponding to that in FIG. 2, of the battery-operated screwdriver but in the driving position of the grip housing.

As can be seen from the sectional representation in FIG. 4, two microswitches 16 and 17, by means of which the electric drive motor 9 can be switched on and off, are arranged on the inner shell 4. The microswitches 16 and 17 are situated on diagonally opposite sides of the drive motor 9. Each of the microswitches 16 and 17 is assigned to one direction of rotation of the electric drive motor 9.

Figure 7:
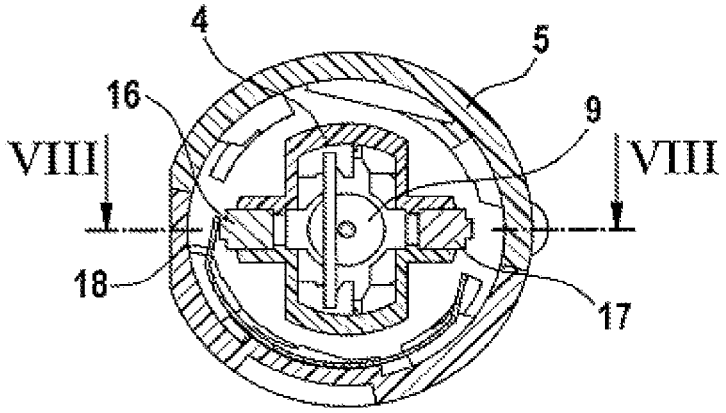
FIG. 7 shows a section transversely to the longitudinal axis along line of section VII-VII in FIG. 5.
Figure 8:
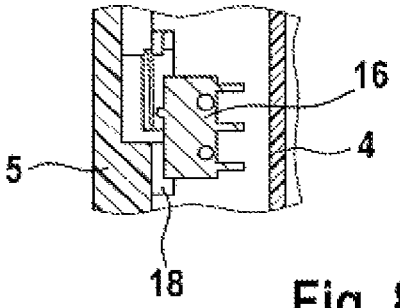
FIG. 8 shows a section along line of section VIII-VIII in FIG. 7.

The microswitches 16 and 17 are actuated by means of an actuating element 18, which is embodied as a leaf spring and is secured on the inside of the grip housing 5. During a relative rotary motion of the grip housing 5 with respect to the inner shell 4, the leaf spring 18 also moves relative to the inner shell 4 and hence also to the microswitches 16 and 17 mounted on the inner shell 4. Depending on the direction of rotation of the grip housing 5, one or the other end of the leaf spring 18 comes into contact with one of the microswitches 16 or 17 and switches it on, with the result that the drive motor too is put into operation. The ON state is illustrated in FIGS. 5 to 8. In FIG. 7, it can be seen that one end of the leaf spring 18 is resting against microswitch 16 and switching the latter on. As soon as the grip housing 5 is twisted back in the direction of the initial or neutral position, the leaf spring 18 disengages from the microswitch and, as a result, the latter is switched off and the electric drive motor is switched off.

The switch-on operation proceeds as follows:

First of all, the user specifies the direction of rotation in which the electric motor is to revolve by twisting the grip housing 5 about the longitudinal axis 6. With respect to an initial or neutral position, the grip housing 5 can be twisted over a limited angular range of, for example, plus/minus 10° in relation to the inner shell 4. The grip housing 5 is then moved axially towards the inner shell 4, as a result of which the relevant microswitch 16 or 17 is switched on by one end of the leaf spring 18, whereupon the motor begins to run in the desired direction of rotation. The axial setting motion takes place counter to the force of the spring element 12. With the axial motion, the latching pin 15 on the inside of the grip housing 5 enters one of grooves 13 and 14 on the outer circumference of the inner shell 4, each of the grooves 13 and 14 being assigned to one direction of rotation of the electric drive motor. This prevents the grip housing 5 from twisting in relation to the inner shell 4 during operation, something which could otherwise lead to accidental reversal of the direction of rotation of the drive motor.

On completion of the working process, a reduction in the holding force allows the grip housing 5 to return axially into the retracted position thereof by virtue of the action upon it of the spring element 12, thereby ensuring that the leaf spring 18 disengages from the respective microswitch 16 or 17 and the motor is switched off. Simultaneously with the axial return motion, the latching pin 15 disengages from the associated groove 13 or 14, thus allowing the grip housing 5 to then be twisted back in the direction of the initial or neutral position about the longitudinal axis.

What is claimed is:

1. A handheld power tool, comprising:

a tool holder configured to hold a tool;

a grip housing configured to hold and guide the handheld power tool;

a drive unit providing a driving motion to the tool holder;

at least one microswitch operable to switch the drive unit off or on; and an actuating element configured to act on the microswitch, wherein a relative motion of the tool holder and the grip housing is configured to be transmitted as a switching motion to the at least one microswitch so as to switch the drive unit either on or off, wherein the tool holder and the grip housing are configured to be moved relative to one another in a direction of rotation about and axially along a longitudinal axis of the grip housing, and wherein the switching motion comprises a rotational motion of the grip housing about the longitudinal axis followed by an axial motion of the grip housing relative to the tool holder to thereby move the actuating element and microswitch relative to each other so that the actuating element acts on the at least one microswitch.

2. The handheld power tool according to claim 1, wherein the rotational direction of the rotational motion simultaneously determines a direction of the driving motion of the drive unit.

3. The handheld power tool according to claim 1, wherein, in relation to a neutral position, the grip housing is configured to be moved in opposite directions of rotation to produce an opposite driving motion of the drive unit.

4. The handheld power tool according to claim 3, wherein the at least one microswitch includes two microswitches that are configured to switch on the drive unit in a desired driving direction.

5. The handheld power tool according to claim 1, wherein the actuating element includes a leaf spring.

6. The handheld power tool according to claim 1, wherein the actuating element is positioned on the inside of the grip housing.

7. The handheld power tool according to claim 1, further comprising a component that is connected to the tool holder, wherein the at least one microswitch is arranged on the component.

8. The handheld power tool according to claim 1, further comprising an inner shell that houses the drive unit, wherein the tool holder is connected to the inner shell.

9. The handheld power tool according to claim 1, further comprising a spring element configured and arranged to counteract the relative axial motion of the tool holder and the grip housing.

10. The handheld power tool according to claim 1, further comprising:

the grip housing is in a driving position at the end of the switching motion;

a first latching element arranged on the grip housing, and a second latching element connected to the tool holder, wherein, in the driving position, the first latching element is positioned in mating engagement with the second latching element to prevent further rotational movement of the grip housing.

11. The handheld power tool according to claim 10, wherein:

the first latching element includes a pin arranged on the inside of the grip housing, and the second latching element includes a groove structure configured to mate with the pin.

12. The handheld power tool according to claim 10, wherein the first latching element and the second latching element are configured to secure the relative position of the tool holder and the grip housing in the driving position by a relative twisting of the latching elements.

* * * * *